US005427044A

United States Patent [19]

Hirabayashi

[11] Patent Number: 5,427,044

[45] Date of Patent: Jun. 27, 1995

[54] SEWING MACHINE AND METHOD OF PATTERN SELECTION

[75] Inventor: Shintaro Hirabayashi, Nagoya, Japan

[73] Assignee: Brother Kogyo Kabushiki Kaisha, Nagoya, Japan

[21] Appl. No.: 262,483

[22] Filed: Jun. 20, 1994

[30] Foreign Application Priority Data

Jul. 26, 1993 [JP] Japan ..... 5-183677

[51] Int. Cl.[6] ..... D05B 3/02

[52] U.S. Cl. ..... 112/266.1; 112/445; 112/457; 112/458

[58] Field of Search ..... 112/121.12, 456, 457, 112/458, 453, 454, 103, 266.1, 262.3, 121.11; 364/470

[56] References Cited

U.S. PATENT DOCUMENTS 4,622,907 11/1986 Kimura ..... 112/445
4,742,786 5/1988 Hashimoto et al. ..... 112/121.12
5,005,500 4/1991 Kato et al. ..... 112/457
5,231,941 8/1993 Wakayama ..... 112/121.12
5,333,560 8/1994 Yoshida ..... 112/445 X

FOREIGN PATENT DOCUMENTS 5-42268 2/1993 Japan .

*Primary Examiner*—Peter Nerbun
*Attorney, Agent, or Firm*—Oliff & Berridge

[57] ABSTRACT

A sewing machine that permits selection of an outer profile for a frame pattern on an outer profile selection screen displayed on a pattern display, selection of a line shape for the frame pattern on a line shape selection screen displayed on the pattern display, and sewing of the frame pattern in accordance with a combination of the selected outer profile and line shape. Accordingly, since an outer profile and a line shape for a frame pattern are selected in combination, a large number of patterns can be selected using a small number of pattern selection screens and a frame pattern can be selected simply on the sewing machine.

18 Claims, 3 Drawing Sheets

SEWING MACHINE AND METHOD OF PATTERN SELECTION

BACKGROUND OF THE INVENTION

1. Field of the Invention

This invention relates to a sewing machine which can form a sewing pattern on a work fabric and, more particularly, to a sewing machine wherein a desired sewing pattern can be selected readily.

2. Description of the Related Art

Conventionally, in a sewing machine which can form a pattern, when it is tried to form a frame pattern in order to produce, for example, an emblem, one of a plurality of frame patterns which are different in outer profile and line shape from one another is selected. In particular, for example, with a sewing machine having frame patterns composed of combinations of four different outer profiles and ten different line shapes, an operator searches out and selects a frame pattern having a desired outer profile and a desired line shape from among a total of 40 different frame patterns displayed on a front panel of the sewing machine.

The conventional sewing machine, however, is disadvantageous in that the user must search out a desired one of a large number of frame patterns displayed on the front panel of the sewing machine. The operation to search for the desired frame pattern becomes more complicated as the number of frame patterns involved increases.

SUMMARY OF THE INVENTION

It is an object of the invention to provide a sewing machine by which a desired pattern can be selected readily from among a large number of patterns.

In order to attain the object described above, according to the invention, a sewing machine which includes stitch formation means for moving a work fabric relative to an upwardly and downwardly movable sewing needle to form stitches on the work fabric comprises storage means for storing a plurality of different frame patterns, outer profile selection means for selecting an outer profile from among a plurality of different outer profiles, line shape selection means for selecting a line shape from among a plurality of different line shapes, and control means for reading out from the storage means a frame pattern having the outer profile selected by the outer profile selection means and the line shape selected by the line shape selection means and causing the stitch formation means to form the frame pattern read out from the storage means on the work fabric.

With the sewing machine, the outer profile selection means is used to select an outer profile from among the plurality of different outer profiles. Then, the line shape selection means is used to select a line shape from among the plurality of different line shapes. The control means then reads out from the storage means a frame pattern which is composed of the outer profile selected using the outer profile selection means and the line shape selected using the line shape selection means, and the frame pattern thus read out from the storage means is formed on a work fabric by the stitch formation means.

BRIEF DESCRIPTION OF THE DRAWINGS

A preferred embodiment of the invention will be described in detail with reference to the following figures, wherein.

DETAILED DESCRIPTION OF THE PREFERRED EMBODIMENT

The structure of a sewing machine in an embodiment according to the invention will be described with reference to FIGS. 1 and 2.

Figure 1:
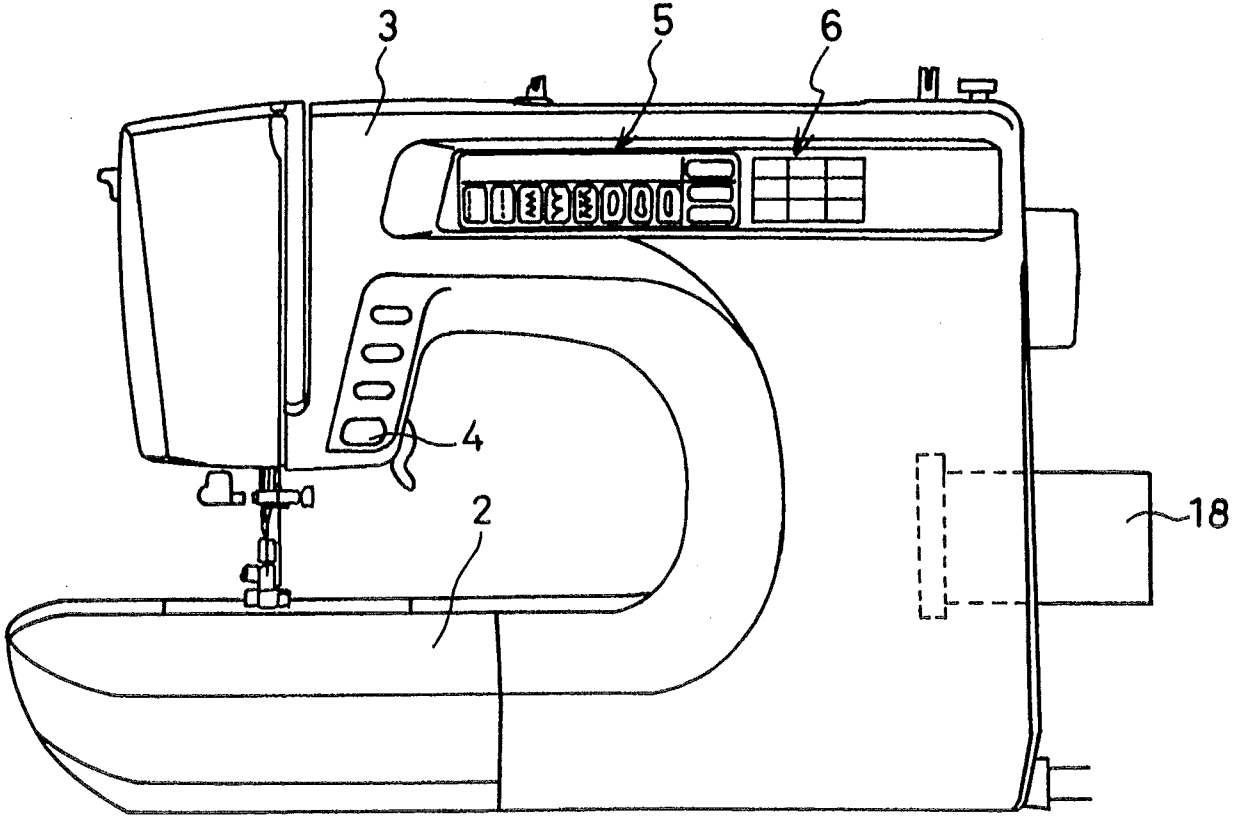
FIG. 1 is a front elevational view showing a body of a sewing machine in the embodiment of the invention.
Figure 2:
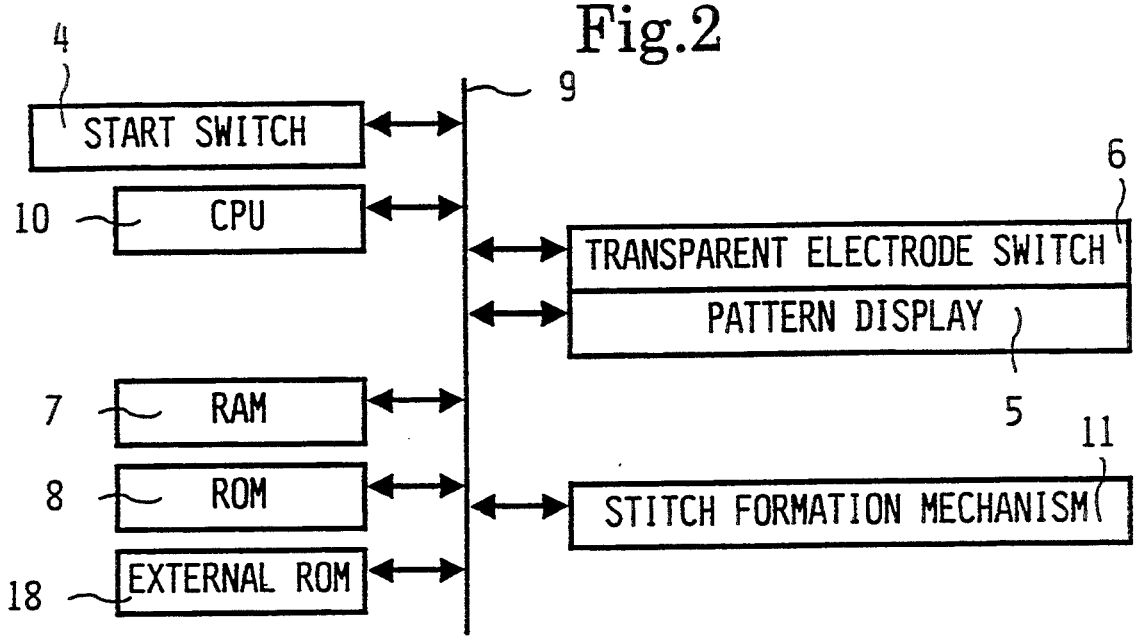
FIG. 2 is a block diagram of the electric circuit structure of the embodiment.

As shown in FIG. 1, the body of the sewing machine includes a sewing machine bed 2 having a substantially rectangular outer profile like a box, and a sewing machine arm 3. The sewing machine arm 3 extends uprightly from an upper portion of a right portion of the sewing machine bed 2 and then extends horizontally substantially in parallel to the sewing machine bed 2 to a location above a left portion of the sewing machine bed 2. Various operation switches, including a start switch 4 for starting operation of the sewing machine, are provided on a front face of a left portion of the sewing machine arm 3. A pattern display 5 formed of a liquid crystal display (LCD) is located on the front face of an upper portion of the sewing machine arm 3. The pattern display 5 can display thereon an outer profile selection screen 12 (FIG. 4), a line shape selection screen 13 (FIG. 5) and a pattern settlement screen 14 (FIG. 6), which will be hereinafter described.

A transparent electrode switch 6 is located on a surface of the pattern display 5 in such a manner as to cover the pattern display 5. If an operator lightly touches the transparent electrode switch 6 at a portion of an outer profile or a line shape for a stitch pattern displayed on the pattern display 5, then the outer profile or the line shape for the stitch pattern is selected. Detailed structures of the pattern display 5 and the transparent electrode switch 6 are disclosed in Japanese Patent Laid-Open Application No. Hei 5-42268, and the description thereof will be omitted herein.

The electric circuit structure of the sewing machine of the embodiment will be described with reference to FIG. 2. The pattern display 5 is connected to a CPU 10 by way of a bus 9. Pattern display data and pattern sewing data for the stitch patterns are stored in a ROM 8. Pattern display data in the ROM 8 are transferred to the pattern display 5 via the bus 9 by the CPU 10, and are displayed thereon. The pattern sewing data are sent to a stitch formation mechanism 11 by which a pattern is formed on a work fabric. The transparent electrode switch 6, provided in such a manner as to cover the pattern display 5, is connected to the CPU 10 and transmits selection information of a pattern to the CPU 10. A RAM 7 is connected to the CPU 10 via the bus 9 and is used to temporarily store information. An external ROM 18 is removably loaded on the sewing machine. The external ROM 18 stores pattern display data and pattern sewing data of an arbitrary stitch pattern. When the external ROM 18 is loaded on the sewing machine, a stitch pattern other than the stitch patterns stored in the ROM 8 can be selected.

Figure 3:
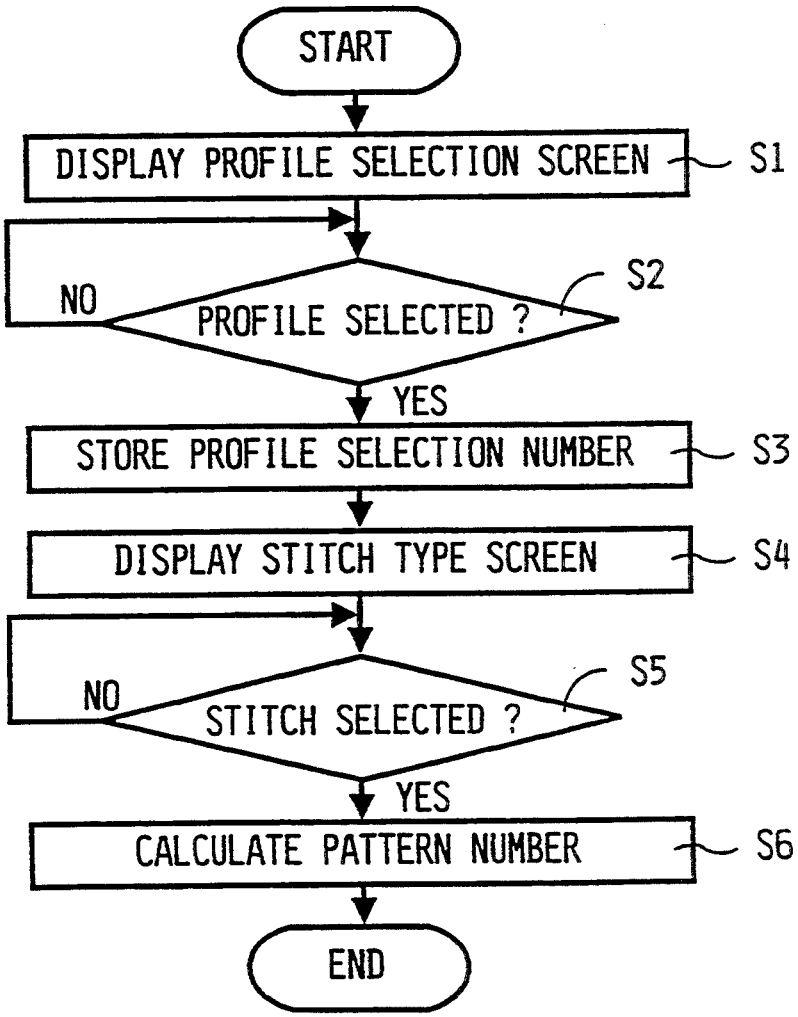
FIG. 3 is a flow chart illustrating a pattern selection method with the embodiment.
Figure 4:
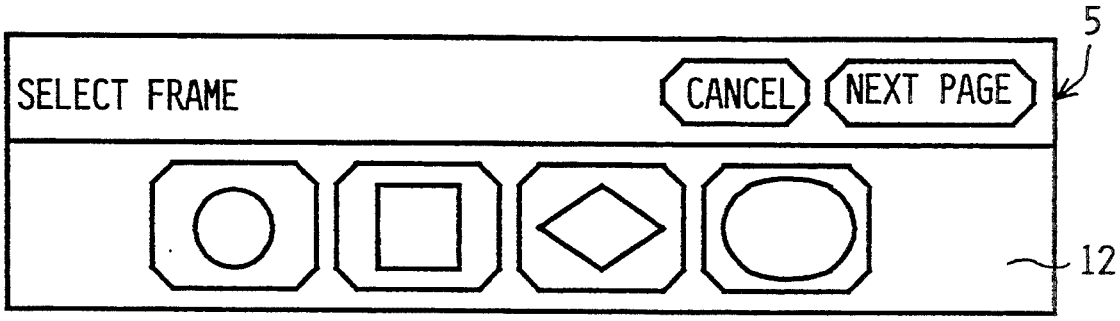
FIG. 4 is a schematic illustration showing an outer profile selection screen of a pattern display of the embodiment.

Operation of the sewing machine in the embodiment will now be described with reference to the flowchart of FIG. 3 and the selection screens shown in FIGS. 4 to 6. It is assumed here that, in the embodiment, four different outer profiles and ten different line shapes (stitch types) for different frame patterns are available.

First, the operator will lightly touch a mode change switch, not shown, of the transparent electrode switch 6 to put the mode of the sewing machine into a frame pattern selection mode. Consequently, the CPU 10 reads out data of the outer profile selection screen 12 from the ROM 8 and causes the pattern display 5 to display the outer profile selection screen 12 thereon as shown in FIG. 4 (step 1: hereinafter referred to as S1, which similarly applies to all of the following steps). If the operator lightly touches the pattern display 5, for example, at the portion of "circular frame" of the first outer profile, then the CPU 10 determines that the outer profile of the frame has been selected (S2: Yes). Then, the CPU 10 temporarily stores, into the RAM 7, the information that the outer profile selected at the outer profile selection screen 12 is the "circular frame" (S3).

Figure 5:
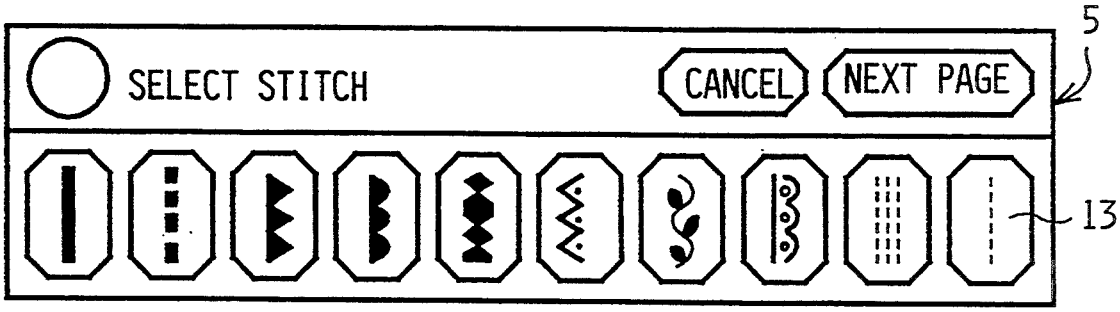
FIG. 5 is a schematic illustration showing a stitch selection screen of the pattern display of the embodiment.

Subsequently, the CPU 10 reads out data of the stitch type screen 13 from ROM 8 or external ROM 18 and causes the pattern display 5 to display the stitch type screen 13 (S4), as shown in FIG. 5. Here, if the operator lightly touches the transparent electrode switch 6 at the portion of, for example, the fourth stitch, that is, the stitch whose line shape of the frame is a "semi-circular shape," then the CPU 10 determines that the "semi-circular shape" has been selected as the line shape of the frame (S5: Yes). The CPU 10 then temporarily stores into the RAM 7 the information that the line shape selected at the stitch type screen 13 is the "semi-circular shape." Then, the CPU 10 selects a stitch pattern based on the outer profile of the frame, i.e., the selected "circular frame" and stored in the RAM 7 and the line shape of the frame, i.e., the "semi-circular shape" just selected, and reads out pattern display data regarding the frame pattern having a semi-circular line shape and a circular overall profile from the ROM 8. Further, the CPU 10 causes the pattern display 5 to display the developed pattern screen 14 as shown in FIG. 6, and then reads out pattern display data corresponding to the selected pattern from the ROM 8 and causes the pattern display 5 to display the pattern display data. Thereafter, the CPU 10 waits in a condition in which it is ready to read pattern sewing data corresponding to the selected pattern from the ROM 8 (S6).

If the operator depresses the start switch 4 to render the sewing machine operative after the outer profile and the line shape for a frame pattern are settled in this manner, then the CPU 10 causes the stitch formation mechanism 11 to be operated in accordance with pattern sewing data read out from the ROM 8. As a result, the frame pattern having a semi-circular line shape and a circular overall profile is sewn on the fabric.

On the other hand, if the user depresses a "CANCEL" switch when the pattern display 5 displays the outer profile selection screen 12, then the sewing machine returns from the frame pattern selection mode to another mode previously displayed on the pattern display 5.

In contrast, if the user depresses the "CANCEL" switch when the pattern display 5 displays the stitch type screen 13, then the pattern display 5 returns from the stitch type screen 13 to the outer profile selection screen 12 while the selected outer profile is erased from the RAM 7. Then, the user can select another outer profile from the outer profile selection screen 12.

Further, if the user depresses the "CANCEL" switch when the pattern display 5 displays the developed pattern screen 14, then the pattern display 5 returns from the developed pattern screen 14 to the stitch type screen 13 while the selected line shape is erased from the RAM 7. Then, the user can select another line shape using the stitch type screen 13.

As is apparent from the foregoing description, in the sewing machine according to the invention, there is a superior advantage in that, since a frame pattern is selected as a combination of an outer profile and a stitch type, a large number of patterns can be selected readily by way of a small number of selection screens.

It is to be noted that the invention is not limited to the embodiment described in detail above and various alterations and modifications can be made within the spirit and the scope of the invention.

For example, although an outer profile is selected first and then a stitch type is selected so that the selected frame pattern is produced in the embodiment described above, selection may be performed in the reverse order.

Further, while, in the embodiment, the number of factors which are used for selection is limited to the two factors of the outer profile and the line shape for a frame pattern, some other factors such as contents of a frame pattern may additionally be used for selection.

Further, while four different outer profiles and ten different line shapes are available in the embodiment described above, the number of such outer profiles and line shapes can be increased or decreased. Furthermore, where the number of outer profiles or line shapes is so great that all of such outer profiles or line shapes cannot be displayed on a single screen of the pattern display 5, the sewing machine may be constructed such that different outer profiles or line shapes are displayed in response to depression of such a "NEXT PAGE" switch as seen in FIGS. 4 and 5.

Figure 6:
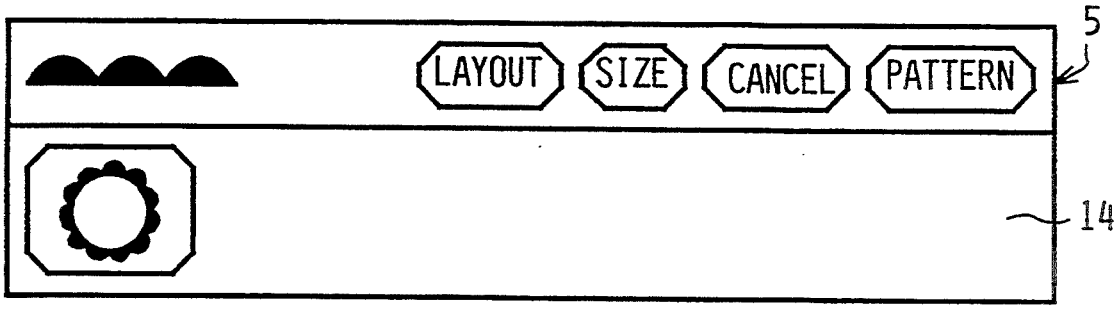
FIG. 6 is an illustrative view showing a pattern settlement screen of the pattern display of the embodiment.

Furthermore, the sewing machine may be constructed such that, when the user wants to see a layout of a selected frame pattern, should a "LAYOUT" switch, such as shown in FIG. 6 be depressed that, thereupon, the pattern display 5 displays a screen, not shown, which indicates at which portion of an embroidery frame the frame pattern is to be formed.

Further, the sewing machine may be constructed such that, when the user wants to change the size of a selected frame pattern, should a "SIZE" switch, such as shown in FIG. 6 be depressed that, thereupon, the pattern display 5 displays a screen, not shown, which indicates the size the frame pattern is to be formed with respect to the embroidery frame.

What is claimed is:

1. A sewing machine which includes stitch formation means for moving a work fabric relative to an upwardly and downwardly movable sewing needle to form stitches on the work fabric, comprising:

storage means for storing a plurality of different frame patterns made up of combinations of a plurality of different outer profiles and a plurality of different line shapes;

outer profile selection means for selecting an outer profile from among the plurality of different outer profiles;

line shape selection means for selecting a line shape from among the plurality of different line shapes; and control means for reading out from said storage means a frame pattern having the outer profile selected by said outer profile selection means and the line shape selected by said line shape selection means and causing said stitch formation means to form the frame pattern read out from said storage means on the work fabric by stitching the entire selected outer profile using the selected line shape.

2. The sewing machine according to claim 1, wherein said outer profile selection means and said line shape selection means include display means for displaying the plurality of different outer profiles or the plurality of different line shapes, and selection means for selecting a desired outer profile or a desired line shape from among the plurality of different outer profiles or the plurality of different line shapes displayed on said display means.

3. The sewing machine according to claim 2, wherein said display means includes a liquid crystal display, and said selection means includes a transparent electrode switch provided in such a manner as to cover said liquid crystal display.

4. The sewing machine according to claim 2, further comprising next page display means for causing, when said display means cannot display all of the plurality of different outer profiles or the plurality of different line shapes, said next page display means to display those of the outer profiles or line shapes which have not been displayed on said display means as of yet.

5. The sewing machine according to claim 2, further comprising cancellation means for returning, when one of the plurality of different outer profiles or the plurality of different line shapes which has been selected by said selection means is to be changed, the display of said display means to the display of the plurality of different outer profiles or the plurality of different line shapes.

6. The sewing machine according to claim 2, wherein said control means reads out from said storage means a frame pattern having an outer profile selected by said outer profile selection means and a line shape selected by said line shape selection means and causes said display means to display the selected frame pattern.

7. The sewing machine according to claim 6, further comprising layout display means for causing a layout of the selected frame pattern to be displayed.

8. The sewing machine according to claim 6, further comprising changing means for changing a size of the selected frame pattern.

9. The sewing machine according to claim 1, wherein said storage means is removably loaded in said sewing machine.

10. A pattern selection apparatus for use with a sewing machine which includes stitch formation means for forming stitches on a work fabric, comprising:

a memory for storing a plurality of different frame patterns;

outer profile selection means for selecting an outer profile from among a plurality of different outer profiles;

line shape selection means for selecting one kind of line shape from among a plurality of different line shapes; and control means for reading out from said storage means a frame pattern having the outer profile selected by said outer profile selection means and the line shape selected by said line shape selection means and for controlling stitching of the frame pattern with the selected outer profile and using the selected line shape over the entire outer profile.

11. The pattern selection apparatus according to claim 10, wherein said outer profile selection means and said line shape selection means include display means for displaying the plurality of different outer profiles or the plurality of different line shapes, and selection means for selecting a desired outer profile or a desired line shape from among the plurality of different outer profiles or the plurality of different line shapes displayed on said display means.

12. The pattern selection apparatus according to claim 11, wherein said display means includes a liquid crystal display, and said selection means includes a transparent electrode switch provided in such a manner as to cover said liquid crystal display.

13. The pattern selection apparatus according to claim 11, further comprising next page display means for causing, when said display means cannot display all of the plurality of different outer profiles or the plurality of different line shapes, said display means to display those of the outer profiles or line shapes which have not been displayed on said display means as of yet.

14. The pattern selection apparatus according to claim 11, further comprising cancellation means for returning, when one of the plurality of different outer profiles or the plurality of different line shapes which has been selected by said selection means is to be changed, the display of said display means to the display of the plurality of different outer profiles or the plurality of different line shapes.

15. The pattern selection apparatus according to claim 11, wherein said control means reads out from said storage means a frame pattern having an outer profile selected by said outer profile selection means and a line shape selected by said line shape selection means and causes said display means to display the thus selected frame pattern.

16. The pattern selection apparatus according to claim 15, further comprising layout display means for causing a layout of the selected frame pattern to be displayed.

17. The pattern selection apparatus according to claim 15, further comprising changing means for changing a size of the selected frame pattern.

18. A pattern selection method for a sewing machine which includes selection means for selecting a frame pattern to be formed on a work fabric, and stitch formation means for forming the frame pattern selected by said selection means on the work fabric, comprising the steps of:

displaying either a plurality of different outer profiles or a plurality of different line shapes on a display;

selecting an outer profile or a line shape from among the plurality of different outer profiles or the plurality of different line shapes displayed on said display;

displaying on said display the plurality of different line shapes or the plurality of different outer profiles which have not been displayed at the first displaying step;

selecting a line shape or an outer profile from among the plurality of different line shapes or the plurality of different outer profiles displayed on said display at the second displaying step;

selecting a frame pattern on the basis of the outer profile and the line shape selected by the first and second selecting steps; and sewing the frame pattern having the selected outer profile and using the selected line shape over the entire outer profile.

* * * * *